United States Patent [19]

Arena

[11] 4,140,169

[45] Feb. 20, 1979

[54] CARRIER FOR VERTICAL BLINDS

[76] Inventor: Joseph P. Arena, 254-43 Pembroke Ave., Great Neck, N.Y. 11020

[21] Appl. No.: 824,836

[22] Filed: Aug. 15, 1977

[51] Int. Cl.[2] ..... E06B 9/30

[52] U.S. Cl. ..... 160/178 R

[58] Field of Search ..... 160/166–178 R, 160/231 A

[56] References Cited

U.S. PATENT DOCUMENTS

| | | | |
|---|---|---|---|
| 2,790,492 | 4/1957 | Toti | 160/173 |
| 3,019,486 | 2/1962 | Stinson | 160/231 A |
| 3,190,346 | 6/1965 | Arena et al. | 160/172 |

FOREIGN PATENT DOCUMENTS

| | | | |
|---|---|---|---|
| 1374428 | 11/1974 | United Kingdom | 160/166 A |

*Primary Examiner*—Peter M. Caun

*Attorney, Agent, or Firm*—Kenyon & Kenyon Reilly Carr & Chapin

[57] ABSTRACT

A unitary, one-piece vane carrier for vertical blinds is disclosed. The unitary carrier includes a carrier body and an elongated spacer link extending from one end of the body, the spacer link and body forming a single, unitary piece. In a disclosed embodiment, a tab is disposed at the distal end of the spacer link and a slotted opening is located in the end of the carrier body opposed to the end from which the spacer link extends. In that embodiment, the tab of one carrier cooperates with the slotted opening of an adjacently positioned carrier to limit the maximum spacing between the two carriers. The spacer link extends from the top of one end of the carrier body while the slotted opening is oppositely located at the top of the other end such that the spacer link of one carrier is slidable through the slotted opening of the adjacent carrier. Also in that disclosed embodiment, the spacer link includes a section of reduced width to facilitate insertion and removal of the spacer link into and from the slotted opening of an adjacent carrier and a section of reduced thickness to permit flexing of the spacer link thereat to facilitate stacking of the spacer links when the carriers are bunched.

15 Claims, 6 Drawing Figures

CARRIER FOR VERTICAL BLINDS

BACKGROUND OF THE INVENTION

1. Field of the Invention

The present relates generally to vertical blinds and more particularly to a unitary, one-piece vane carrier therefor.

2. Description of the Prior Art

Vanes of vertical blinds are usually supported by and suspended from members commonly referred to as carriers. The carriers include means interconnecting them to limit the distance by which they may be separated; such means are commonly referred to as spacers or spacer links. The carriers also include means for mounting drive means for rotating the vanes and at least one of the carriers in the blind includes means by which that carrier may be moved along the track or traversed. In carriers of the type which include gearing driven by a rod extending through the carrier, such as those disclosed in, for example, U.S. Pat. Nos. 3,996,988 and 3,343,588, it is important that the width of the carrier be small so that the vanes may be compactly bunched or stacked. It is also important that such carriers be constructed so that they slide smoothly along the track for the blinds without binding, permit smooth rotation of the vanes, and so that the carriers may easily be mounted in the track and interconnected, and disengaged and removed. The prior art carriers are particularly burdensome when interconnecting and disengaging the spacers and the carriers; the prior art carriers also tend to bind during traversing. Thus, prior art carriers have not been completely satisfactory and additionally they are complex, and are expensive and difficult to manufacture and assemble.

In the prior art, U.S. Pat. No. 3,343,588, discloses an arrangement of two levels of carriers which alternate in supporting the vanes for reducing the spacing between the vanes when the vanes are bunched. The spacers and carriers are separate pieces and the spacers are secured to the carriers in the slot through which the spacer of an adjacently interconnected carrier extends which make the carriers prone to binding during traversing. In U.S. Pat. No. 3,996,988, the spacers and carriers are also separate pieces, similarly making the carriers prone to binding. U.S. Pat. Nos. 2,635,686 and 2,790,492 disclose spacers which do not include a carrier body and are not adaptable to include therein gearing for rotating the vanes. The spacers disclosed in these latter two patents are also susceptible to binding since the spacers must be rocked to rotate the vanes, and the vanes are not rotatable in any traverse location of the spacers.

The present invention overcomes the aforementioned drawbacks and disadvantages of the prior art and provides a new and improved carrier which is simple and inexpensive to manufacture and assemble, is compact, smoothly traversable essentially without binding, permits smooth rotation of the vanes and permits easy mounting, interconnection and disengagement of the carriers.

SUMMARY OF THE INVENTION

Carriers for supporting vanes of vertical blinds according to the invention comprise unitary, one-piece members which include a body and an elongated spacer extending from and forming a single, unitary piece with the body. The carrier body includes means for housing drive means for rotating the vanes and the body and spacer include cooperating stop means for interconnecting and retaining the spacer of one carrier in an adjacently mounted carrier. The carrier preferably includes means permitting hinging of the spacer. Preferably, the carrier according to the invention is of a molded construction made from a low friction plastic such as Du Pont Zytel 105, Nylon, Delrin, etc.

In a disclosed embodiment, the spacer extends in a horizontal direction with reference to the mounted position of the carrier, is generally flat and of rectangular cross section and has a tab at the end thereof, the lab having a beveled or camming edge. The carrier body includes a slotted opening which cooperates with the tab to prevent the spacer from being axially withdrawn through the slotted opening. The spacer also includes a section of reduced material content by means of which the spacer is inserted into the slotted opening and a section which permits flexing or hinging of the spacer substantially at that section to facilitate stacking of the spacer when the vanes are bunched together. A or camming beveled portion is provided in the end of the carrier body from which the spacer extends which cooperates with the the camming edge of the tab of the spacer link to facilitate stacking. The carrier is adapted to house a worm rotatably snap-fitted into the carrier body and engagable by a rod extending through the carrier body, and also a worm wheel and means for supporting a vane, the worm meshing with the worm wheel whereby rotation of the rod rotates the vane.

A unitary carrier according to the invention permits the spacer to be located at either end of the carrier body at substantially any desired located thereat since the carrier and spacer as a unitary member substantially prevents distortion and/or cocking of the carrier body during traversing and rotation, which otherwise may cause binding or restrict carrier traversing.

The carriers according to the present invention are useful in blinds of the type disclosed in my copending application entitled "Vertical Blind Controls", Application Ser. No. 824,834, filed on Aug. 15, 1977.

These and other aspects of the invention will be more apparent from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like references apply to like parts and in which.

DESCRIPTION OF THE PREFERRED EMBODIMENTS

Figures 1, 3, 4:
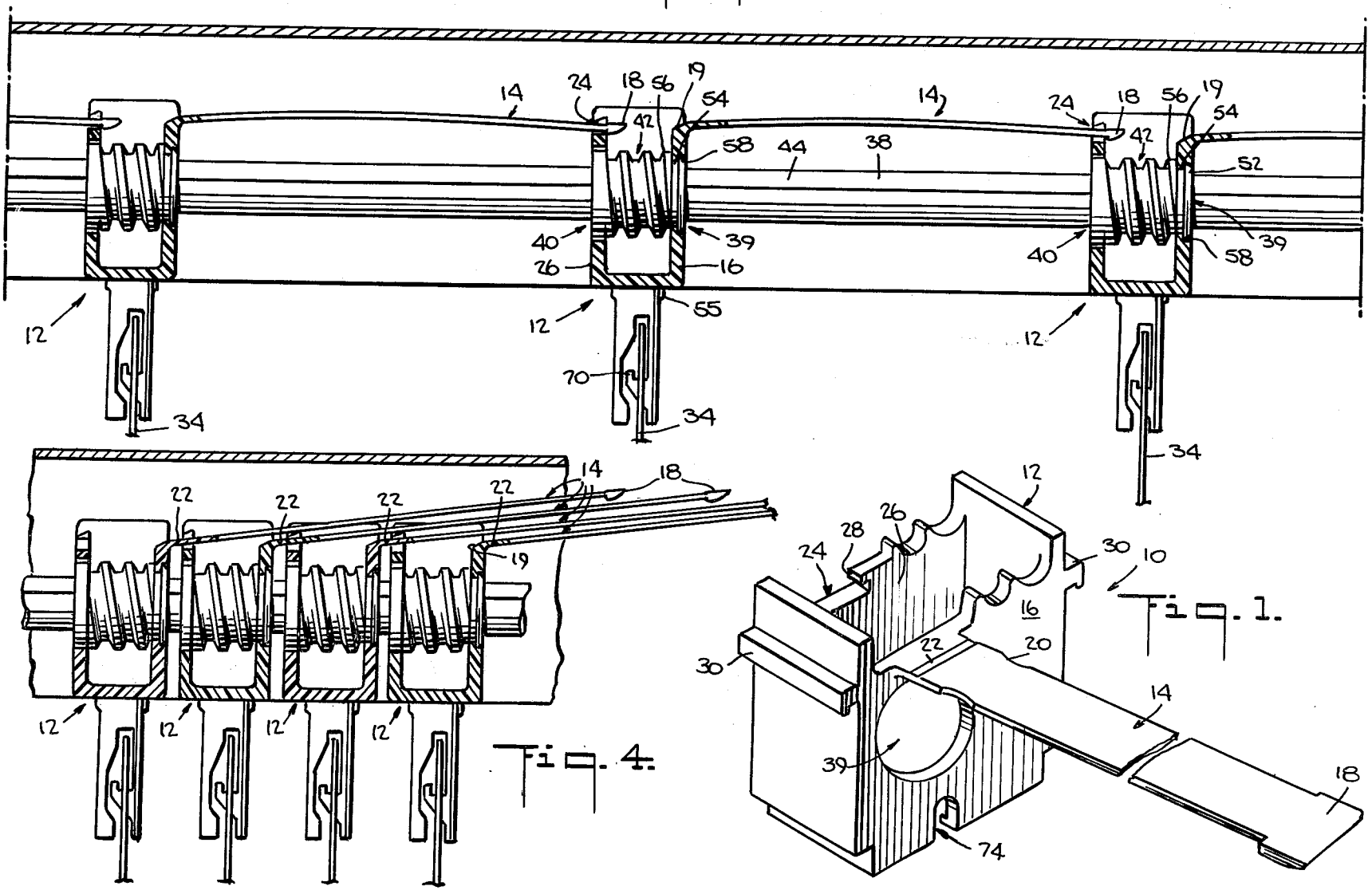
FIG. 1 is a perspective view of the unitary, one-piece carrier according to the invention.
FIG. 3 is a section view taken along line 2-2 of FIG. 2 showing the carrier members supporting the vanes being maximally spaced apart with the vanes in the open position.
FIG. 4 is a section view similar to FIG. 3 showing the carriers and vanes bunched with the spacers stacked.

As shown in FIG. 1, the carrier 10 according to the present invention includes body 12 and spacer 14 homogeneously integral therewith, the body and spacer forming a unitary, one-piece carrier. Spacer 14 extends from a first end 16 of the carrier outwardly therefrom and is generally flat and of generally rectangular cross-section. A tab 18 is located at the distal end of the spacer. The tab is wider and thicker than the rest of the spacer and is beveled having a reduced thickness at its free end to provide a camming surface. A beveled part or cam 19 is provided in a second end 26 of the carrier body adjacent spacer 14 which cooperates with the tab beveled edge to cam or facilitate sliding of the tab of one spacer over the part 19 of the adjacently positioned carrier and to prevent buckling of the spacer during stacking movement. Spacer 14 also includes a section 20 of reduced width and a section 22 of reduced thickness. A slotted opening receptacle 24 is provided in the second end 26 of the carrier located opposite from the spacer. Opening 24 and spacer 14 including tab 18 are sized so that the spacer and slotted opening of adjacently mounted carriers (FIG. 2) may be interconnected for slidable movement therebetween, the spacer being inserted in the slotted opening and slidable therein from the tab to end 16, with the tab interlocking adjacent carriers by preventing the spacer of one carrier from being axially withdrawn from the opening of an adjacent carrier. Thus, the length of the spacers determines the maximum distance that the carriers may be spaced apart. The reduced width section 20 in the spacer permits insertion of the spacer into the top of the slotted opening. The slotted part 28 at the top of the opening 24 prevents the spacer from leaving the opening except at the reduced width section which is slightly wider than the slotted part 28 of the opening. It is contemplated that means other than a reduced width in the spacer may permit insertion of the spacer into the opening of an adjacently positioned carrier. For example, material may be removed from other than the edges of the spacer, for example, from the interior of the spacer, i.e., a hole may be made in the spacer, and the spacer squeezed thereat or stretched to reduce its width thereat for insertion into the opening. Additionally, the tab edges can be made flexible so that they may be bent to pass the tab through the opening, the tab thereafter flexing back to its original shape. With such a tab, the slot 28 is not required. The sides of the slotted part 28 at the top of opening 24 are also beveled to have a camming surface at 29 (FIGS. 1 and 3) to cooperate with the beveled edges or cams of the spacer link tabs to permit sliding or camming of the spacer links over the top of slotted part 28. Referring to FIG. 4, the beveled edges or cams 29*a*, 29*b* cooperate with the beveled edges or cams of tabs 18*a*, 18*b*, respectively, to cam the tabs and spacer links over the slotted part 28. The spacer and carrier are unitarily molded from Du Pont Zytel 105 and the spacer is resilient, being axially and radially flexible. Thus, the spacer need merely be axially flexed or torsioned to insert it into and remove it from slotted opening 24.

Figure 2:
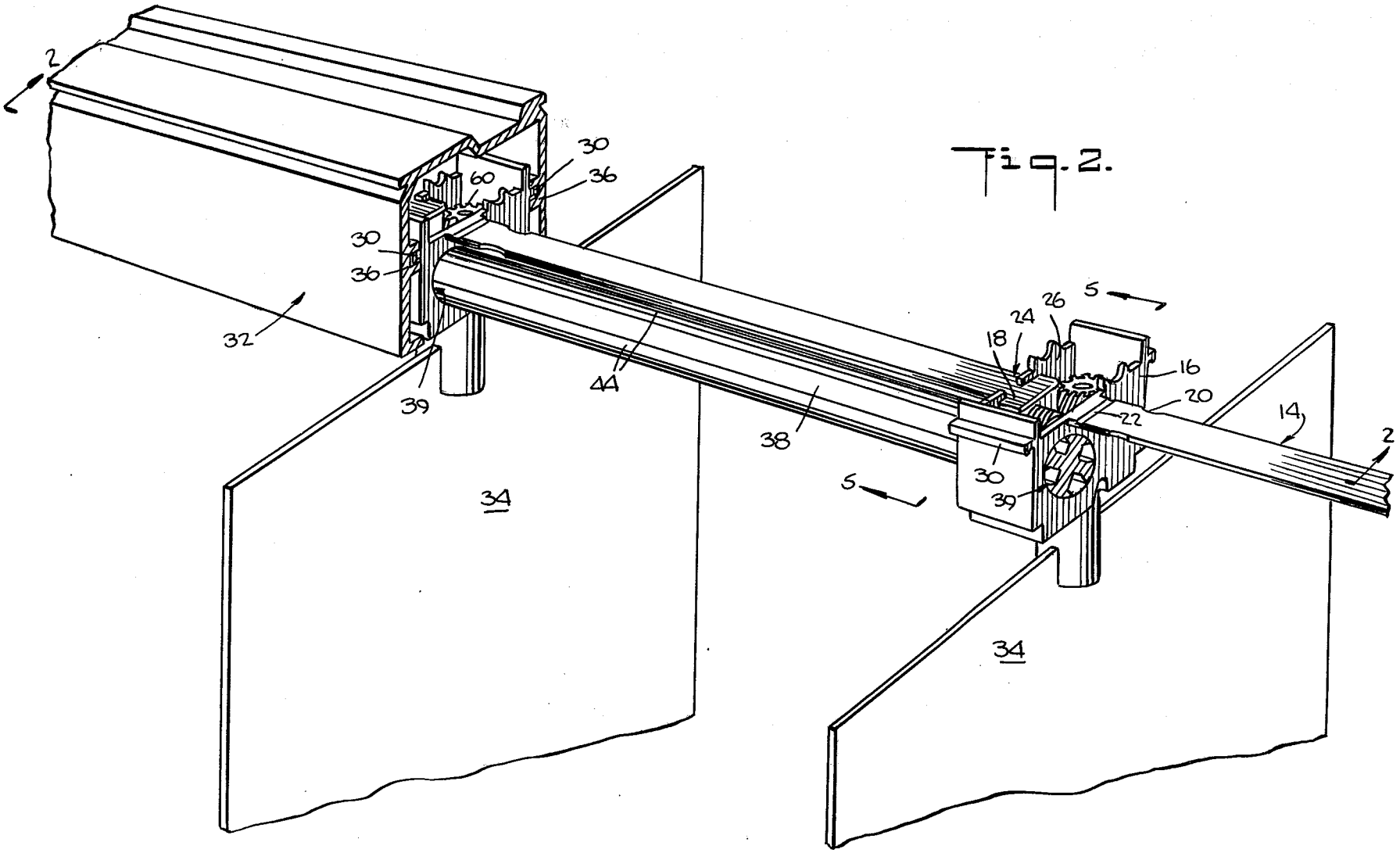
FIG. 2 is a perspective view, party in section, showing the carrier of FIG. 1, the rotation rod, worm and worm wheel for rotating the vanes, and a portion of the supporting track for the carriers.
Figure 5:
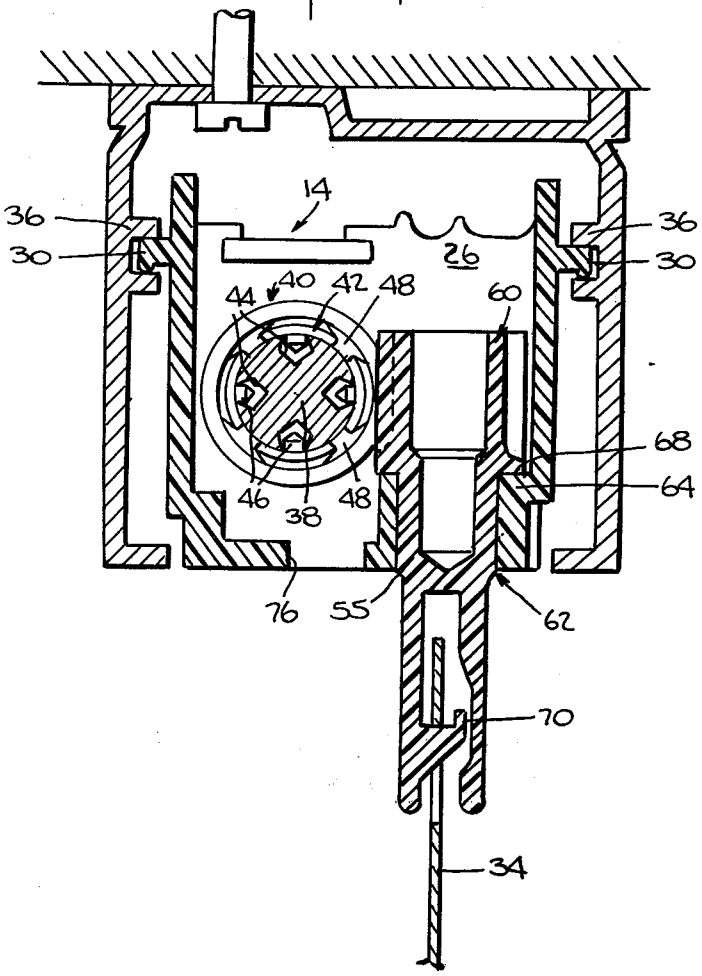
FIG. 5 is a section view taken along line 5-5 of FIG. 2.

As shown in FIGS. 2–4, the carriers are mounted for left-stacking. Referring to FIGS. 1, 2 and 5, carrier 10 includes L-shaped shoulders 30 projecting outwardly from opposed sides of the carrier for supporting the carriers which suspend the vanes 34 in track 32. Also, track 32 includes interior track raceways 36 longitudinally disposed along the interior of opposed sides of the track. The shoulders and raceways are sized so that the carrier may be mounted in and slidably supported by the raceways. The shoulders are L-shaped to reduce the contact area between the tip of the "L" of the shoulders and the raceways, thereby reducing the friction between the shoulders and raceways and facilitating sliding of the carriers. It is also contemplated that wheels and an associated raceway may be used instead of the L-shaped shoulders.

As shown in FIGS. 2–5, the carrier body 12 houses drive means for rotating the vanes which comprise a rotation rod 38 longitudinally disposed within track 32 and extending through opposed openings 39, 40 in the ends of carrier bodies 12. The rod is supported and journaled in opposed ends of the track for rotation thereof. Hollow worms 42 are disposed in carrier bodies 12 and the rotation rod 38 extends through the worms. Female splines 44 extend axially along rotation rod 38 and ribs or male splines 46 extend axially along the inner circumference of worm 42 (FIG. 5). At least one set is required and four sets of splines are shown spaced equally about the outer circumference of the rotation rod and the inner circumference of the worm, respectively. The splines are sized such that the male splines are slidably engaged within the female splines. Thus, the worm will rotate with the rotating rod and is in slidable engagement with respect thereto.

As shown in FIGS. 3 and 5, the worm 42 is snap-fitted into the carrier body 12. To this end, worm 42 is axially slotted at one end thereof intermediate splines 46. Four equally spaced slots 48 are provided as shown in FIG. 5. The end portion of the worm in which the slots are disposed is of reduced outer diameter and terminates in an annular, beveled rib 52 (FIG. 3). An annular slot 54 is formed between the annular rib and the major diameter 56 of the worm screw thread. About opening 39 in carrier body 12 is disposed another annular rib 58 sized to be engaged within annular slot 54. The worm is seated in a carrier by applying an axial force sufficient to flex the portions of the end portion separated by slots 48 radially inwardly so that the annular rib 52 is forced past the annular rib 58 in the carrier. The beveled edge of rib 52 assists in the flexing of the separated end portions. Opening 39, the worm major diameter 56, the reduced diameter end portion, and the annular ribs are all sized so that the worm is rotatable within the carrier. Referring again to FIG. 3, rotation rod 38 is mounted in track 32 extending through the carrier bodies 12 and worms 42 with the worms and rotation rods engaged for common rotation by means of the splines.

Also disposed in carrier bodies 12 for rotation therein are worm wheels 60. As shown in FIG. 5, carrier bodies 12 have a third opening 62 and adjacent shoulder 64. Secured to worm wheel 60 is bushing 55 which is sized and disposed to rotate within opening 62. The bushing is of reduced diameter compared to the worm wheel and, as a result, the end of the worm wheel adjacent the bushing forms a shoulder 68 which is supported by shoulder 64 of the carrier body. Bushing 66 includes an axially slotted section having a hook 70 and vanes 34 include a slot (not shown) for securing the vanes to the bushings. The openings in the carrier bodies and the worms and worm wheels are sized and disposed so that the worms and worm wheels mesh, whereupon rotation of worms 42 cause worm wheels 60 and vanes 34 to rotate.

Referring to FIGS. 2–4, the vanes are traversed by sliding a housing along track 32. The housing is more fully described in my aforementioned copending application. The housing is located at the end of the track and the tab of the spacer located immediately adjacent the housing is engaged in a slotted opening in the housing similar to slotted openings 24. When traversing to the right, the tab of the spacer immediately adjacent to the housing will be engaged by the slotted opening in the housing; the tabs of next adjacent carriers will then be engaged in the slotted openings 24 of respective carriers whereby the spacers will be successively engaged, thereby moving the carriers and vanes to the right. When traversing to the left, the spacer of the carrier immediately adjacent to the housing slides through the slotted opening thereof until the end of the housing contacts the carrier, and continued movement of the housing to the left will move the carrier. The spacers of the other carriers will similarly move through the slotted openings of adjacent carriers and successive carriers will be contacted and bunched with the spacers stacked as the housing is further moved towards the left. The vanes are rotated merely by rotating rotation rod 38 which causes worm 42 and worm wheel 60 to rotate which in turn rotate bushing 66 and vanes 34.

As described hereinbefore, the slotted opening 24 in the carrier body is disposed in the end opposite to that from which the spacer extends and the spacer includes a section 22 of reduced thickness. As the carriers are transversed to the left from the positions shown in FIG. 3 to the positions shown in FIG. 4, spacers slide through the slotted openings and over the oppositely disposed spacer of an adjacent carrier, the stacking of the spacers being facilitated by the flexing or hinging of the spacers upwardly about sections 22.

Figure 6:
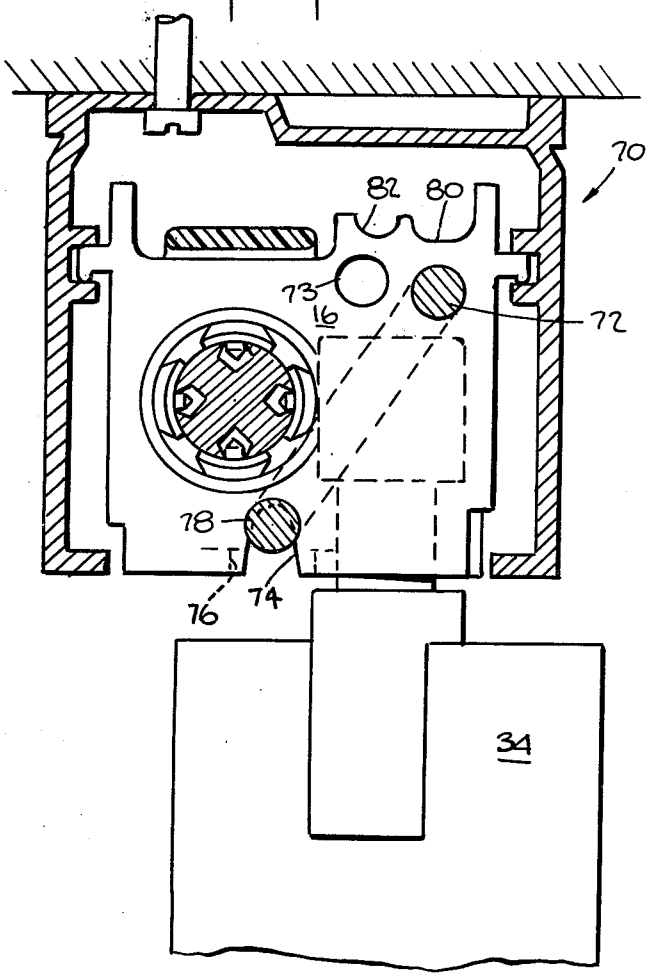
FIG. 6 is an end view from the right, partly in section, of another embodiment of the carrier according to the invention mounted as are the carriers shown in FIG. 2.

FIG. 6 shows a lead carrier body 70 which is adapted to being traversed by a cord and is used in place of one or more of the carrier bodies shown in FIGS. 1–5 and the housing described hereinbefore. It is understood that the lead carrier body will be positioned as the extreme right carrier in a left-stacking blind (FIGS. 2–4), as the extreme left carrier in a right-stacking blind, and that two lead carriers will be used in a biparting blind. Carrier body 70 differs from carrier body 12 in that holes 72, 73, are disposed in end 16 of the carrier body and opening 76 is disposed in the bottom of the carrier body adjacent opening 62. Cords may be attached to the carrier body via such holes as follows. A knot is made in one end of cord 78 or a piece such as a ball or tab (not shown) is affixed or crimped to that cord end, and the opposite running end of the cord is pulled downwardly through opening 76 until the knot or piece is engaged by the carrier body, the knot or piece being larger than opening 76. The cord is run through opening 74 along the exterior of end 16, through hole 72 to the interior of the carrier body and out over the top of end 16 in guide 80. The cord is passed over adjacent carriers in guide 80 to the left end of the track and returned to the control at the right end of the track over the carriers in guide 82. This cord is used for traversing left-stacking carriers to the left (with reference to FIG. 3). Another cord is knotted through hole 73 and run to the control at the right end of the track for traversing left-stacking carriers towards the right (with reference to FIG. 3 also). The carrier body 12 of FIGS. 1–5 may include openings 72, 73, 74 and 76 of carrier body 70 or selected ones thereof to make the carrier bodies interchangeable and formable by a single mold. As shown, carrier body 12 includes openings 74 and 76 and carrier body 70 is made from carrier body 16 by drilling openings 72, 73.

The vanes may be rotated in any traverse position of the carriers of the present invention. Preferably, the vanes are in the open position when they are traversed. The one-piece carriers with the hinged spacers according to the invention are easily interconnected and disengaged as described. Moreover, the one piece carriers are smoothly traversable and the spacers stacked and unstacked all essentially without binding. The carrier bodies are relatively thin, having in one embodiment a thickness from end to end of about 0.4 inches, thereby permitting the vanes to be closely bunched. The carrier bodies and spacers are also easily and inexpensively manufactured as a single, unitary piece by molding.

The advantages of the present invention, as well as certain changes and modifications of the disclosed embodiments thereof, will be readily apparent to those skilled in the art. It is the applicant's intention to cover by his claims all those changes and modifications which could be made to the embodiments of the invention herein chosen for the purposes of the disclosure without departing from the spirit and scope of the invention.

What is claimed is:

1. A unitary, one-piece carrier for vertical blinds comprising:

a carrier body having spaced ends and spaced sides which form an enclosure for housing means for rotatably supporting a blind vane;

an elongated flexible spacer link extending outwardly of said carrier body from a first end thereof and having an enlarged portion at the distal end thereof, said body and said spacer link forming a single, homogeneous, unitary piece;

a receptacle located in a second end of the body at a location approximately opposed and in line with the first end from which said spacer link extends, said receptacle being of a width adapted to receive the spacer link of a next adjacent carrier therein in a sliding relation and including retaining means for retaining the spacer link of the next adjacent carrier therein;

first camming means disposed on said spacer link at the distal end thereof and second camming means cooperating therewith disposed on the first end of said carrier body adjacent said spacer link for camming the spacer link of the next adjacent carrier over said first end of said body; and stop means disposed adjacent said receptacle for engaging the enlarged portion of the spacer link of the next adjacent carrier to prevent the enlarged portion thereof from being axially withdrawn therethrough.

2. The carrier recited in claim 1, wherein said unitary, one-piece carrier comprises a hollow molded member.

3. The carrier recited in claim 2, wherein said carrier is molded of a plastic material.

4. The carrier recited in claim 3 wherein said carrier is molded of Nylon.

5. The carrier recited in claim 1, wherein said enlarged portion of said spacer link is in the form of a tab which is larger than the width of said receptacle such that said tab cannot be axially withdrawn through said receptacle.

6. The carrier recited in claim 5, wherein: said spaced link is generally flat and of generally rectangular cross-section having a width substantially larger than its thickness;

said tab exceeds the width of said spacer link;

said receptacle is of generally rectangular cross-section having a width which is larger than the width of said spacer link but is smaller than that of said tab; and said retaining means overlaps said receptacle at least in part and comprises tab means extending above said receptacle.

7. The carrier recited in claim 6, wherein said tab means define an opening having a width that is less than the width of said receptacle, and wherein said spacer link includes a smoothly-contoured section having a reduced material content located proximate the first end of the carrier body from which it extends, said section being normally slightly greater in size than that of said opening, said section being reducible in cross-sectional size by the application of force to said spacer link, whereby said spacer link may be inserted in and removed from said receptacle through said opening.

8. The carrier recited in claim 7 wherein said reduced material section is a section of reduced width, said width being slightly greater than the width of said opening, whereby said spacer link may be inserted and removed from said receptacle through said opening by flexing thereof.

9. The carrier recited in claim 1, wherein said carrier body is generally hollow and has a bottom, communicating axial openings in said first and seconds ends of said carrier body, and another opening in the bottom of said carrier body, the hollow interior of said carrier body and the axial and other openings being adapted to house a worm, a meshing worm wheel and vane supporting means for rotatably supporting a blind vane, the axial openings being adapted to rotatably retain the worm, and the other opening being adapted to rotatably retain the worm wheel and vane supporting means.

10. The carrier recited in claim 9 and including means disposed along sides of said body for slidably mounting said body in track means.

11. The carrier recited in claim 1, wherein said spacer link includes at least one section of reduced material content located adjacent to the first end of said carrier body to permit said spacer link to be flexed transverse to the axis of the spacer link adjacent to the first end.

12. The carrier recited in claim 1 and including means disposed along the sides of said body proximate the bottom thereof for movably mounting said body in track means and securing means comprising a plurality of openings for securing a cord to said body whereby movement of said cord moves said carrier along said track means.

13. The carrier recited in claim 1, wherein said first and second camming means comprise cooperating inclined surfaces disposed on the distal end of said spacer link and on said first end, said inclined surfaces being cooperatively operative to cam the distal end of the spacer link of the next adjacent carrier over the first end of said carrier body.

14. The carrier recited in claim 13 and including another inclined surface disposed on the top of the second end of said carrier body for assisting the spacer link of the next adjacent carrier to be slid thereover, said other inclined surface operatively cooperating with the inclined surface on the distal end of the spacer link of the next adjacent carrier to cam it over the second end of the carrier body.

15. The carrier as recited in claim 1, wherein the width of said receptacle is sized to stablize and guide the spacer link of the next adjacent carrier as it is slid therein.

* * * * *

UNITED STATES PATENT AND TRADEMARK OFFICE

CERTIFICATE OF CORRECTION

PATENT NO. : 4,140,169

DATED : February 20, 1979

INVENTOR(S) : Joseph P. Arena

It is certified that error appears in the above-identified patent and that said Letters Patent are hereby corrected as shown below:

Column 2, line 11, "lab" should read -- tab --.

Column 2, lines 20-21, "A or camming beveled portion" should read -- A beveled or camming portion --.

Column 2, line 32, "located" should read -- location --.

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*